US005105629A

United States Patent [19]

Parris et al.

[11] Patent Number: 5,105,629

[45] Date of Patent: Apr. 21, 1992

[54] HEAT PUMP SYSTEM

[76] Inventors: Jesse W. Parris, 152 Bon Air Ave.; Howard R. Elston, 289 Falling Creek Rd., both of Spartanburg, S.C. 29303

[21] Appl. No.: 662,277

[22] Filed: Feb. 28, 1991

[51] Int. Cl.[5] ..... F25B 47/02

[52] U.S. Cl. ..... 62/278; 62/324.5

[58] Field of Search ..... 62/81, 160, 278, 324.5

[56] References Cited

U.S. PATENT DOCUMENTS

| | | | |
|---|---|---|---|
| 2,928,255 | 3/1960 | Harnish | 62/81 |
| 3,293,874 | 12/1966 | Gerteis | 62/160 X |
| 4,171,622 | 10/1979 | Yamaguchi et al. | 62/160 |
| 4,197,716 | 4/1980 | Nussbaum | 62/196 B |
| 4,565,070 | 1/1986 | Raymond | 62/81 |
| 4,698,978 | 10/1987 | Jones | 62/160 |
| 4,727,727 | 3/1988 | Reedy | 62/238.6 |
| 4,766,734 | 8/1988 | Dudley | 62/160 |
| 4,774,813 | 10/1988 | Yokoyama | 62/81 |
| 4,798,059 | 1/1989 | Morita | 62/278 X |
| 4,799,363 | 1/1989 | Nakamura | 62/160 |
| 4,916,913 | 4/1990 | Narikiyo | 62/81 |

*Primary Examiner*—William E. Tapolcai
*Attorney, Agent, or Firm*—Dority & Manning

[57] ABSTRACT

A heat pump or the like with a heating, cooling and defrost cycle, the heat pump including an auxiliary heat exchanger that includes a first coil and second coils, the auxiliary heat exchanger operatively connected to a primary refrigerant flow circuit such that hot gaseous refrigerant from the compressor flows through the first coil. The heat pump also includes a bypass refrigerant conduit for bypassing the indoor heat exchanger during the defrost cycle, the bypass conduit connecting the primary circuit to the second coils of the auxiliary heat exchanger so that the second coils act as an evaporator in the defrost cycle. Hot gaseous refrigerant directed through the first coil of the auxiliary heat exchanger warms second coils so that refrigerant directed into the second coils is more efficiently evaporated.

22 Claims, 2 Drawing Sheets

HEAT PUMP SYSTEM

BACKGROUND OF THE INVENTION

The present invention relates generally to refrigeration circuits and, more particularly, to an apparatus to effect defrost of an outdoor heat exchanger incorporated in an air conditioning unit such as a heat pump.

In a conventional refrigeration circuit, a refrigerant compressor, condenser, expansion means, and evaporator are connected to form a refrigerant flow circuit. In operation, the compressor raises the temperature and pressure of gaseous refrigerant, and the gaseous refrigerant is directed to the condenser where it gives off heat energy and is condensed to a liquid. The liquid refrigerant is then directed through an expansion means which reduces its pressure enabling it to be capable of changing from a liquid to a gas absorbing heat energy. The refrigerant is then directed into an evaporator where a change of state from a liquid to gas occurs as heat energy is removed from the media flowing in heat transfer relation with the evaporator. The gaseous refrigerant from the evaporator is then directed back to the compressor.

When a refrigeration circuit is operated under certain ambient conditions, moisture may be deposited on the coil surfaces of the evaporator, and the evaporator coil may develop ice thereon. When ice or frost develops on the coils of the evaporator, the efficiency of the heat exchanger and of the entire system decreases.

Formation of ice on the evaporator coils is particularly a problem with heat pumps since the coil of the outdoor heat exchanger operates as the evaporator when the unit is used to heat a defined enclosed area. Therefore, it is desirable in the operation of a refrigeration circuit, such as a heat pump, to maintain the evaporator coils free of frost and ice. In addition, it is desirable when defrosting the outdoor evaporator coils in a defrost mode, to prevent cold air from being discharged into the enclosed area, and to do so without the necessity of supplemental inefficient electric heat elements such as heat strips being necessary and activated during the defrost cycle.

A number of systems are known for defrosting the evaporator coils in a refrigeration cycle. For example, U.S. Pat. No. 4,171,622 to Yamaguchi et al. provides a heat pump which includes an auxiliary heat exchanger that acts as both a defroster and a subcooler. Refrigerant is directed through a separated coil in the outdoor heat exchanger, which coil acts as a subcooler and a defroster. There is no disclosure of bypassing the indoor heat exchanger, nor is there disclosure of directing hot gaseous refrigerant through a coil in an auxiliary heat exchanger that is only utilized during a defrost mode when the indoor heat exchanger is bypassed.

U.S. Pat. No. 4,565,070 to Raymond, discloses a refrigeration system which incorporates a bypass circuit to bypass the indoor heat exchanger during the defrost mode. This system utilizes two outdoor heat exchangers which alternate operation from evaporator to condenser, one at a time, during the defrost cycle so that each outdoor heat exchanger can be defrosted. During the heating and cooling cycle, refrigerant is directed in series through both outdoor heat exchangers.

U.S. Pat. No. 4,197,716 to Nussbaum discloses a refrigeration circuit which includes a defrost cycle for defrosting the evaporator while bypassing the condenser. Such a system utilizes an auxiliary heat exchanger which is connected in series during the cooling cycle so as to act as a supercooler, and which acts as a condenser during the defrost cycle when the main condenser is bypassed.

U.S. Pat. No. 4,774,813 to Yokoyama, U.S. Pat. No. 4,916,913 to Narikiyo, U.S. Pat. No. 2,928,255 to Harnish and U.S. Pat. No. 4,727,727 to Reedy also disclose various types of heat exchangers.

Thus, various refrigeration systems have been provided that include means for defrosting ice or frost that forms on evaporator coils. However, none provide for the efficient operation of the heat pump and defrost of the outdoor heat exchanger coils while not discharging cold air into the enclosed area, without supplemental heat such as heat strips during normal operation, in the manner as provided by the present invention.

SUMMARY OF THE INVENTION

The present invention recognizes and addresses the foregoing disadvantages, and others, of prior art refrigeration systems. Accordingly, it is an object of the present invention to provide an improved refrigeration system for use as a heat pump or the like.

It is another object of the present invention to provide an efficient heat pump system capable of defrosting an outdoor heat exchanger coil while minimizing the temperature drop in the enclosed area to be heated.

It is a further object of the present invention to provide a more efficient heat pump system for conditioning the air of an enclosed area while maintaining effective heating and cooling of the enclosed area.

It is a further object of the present invention to provide a refrigeration system with an improved defrost cycle.

These and other objects of the present invention are achieved by providing a heat pump or the like with a heating, cooling and defrost cycle, the heat pump including a refrigerant compressor, an outdoor heat exchanger, an indoor heat exchanger, and expansion means all connected by a primary refrigerant flow circuit. The primary refrigerant flow circuit includes a reversing valve for controlling the direction of flow of the refrigerant in the flow circuit. The heat pump includes an auxiliary heat exchanger, the auxiliary heat exchanger including a first coil means and a second coil means, the auxiliary heat exchanger operatively connected to the primary refrigerant flow circuit such that hot gaseous refrigerant from the compressor flows through the first coil means. The heat pump also includes a bypass refrigerant conduit means for bypassing the indoor heat exchanger during the defrost cycle, the bypass conduit means connecting the primary refrigerant flow circuit means to the second coil means of the auxiliary heat exchanger so that the second coil means operates as an evaporator in the defrost cycle. The heat pump further includes valve means operative to direct the refrigerant to the indoor heat exchanger during the heating cycle, the valve means further operative to direct the refrigerant through the bypass conduit means and into the second coil means of the auxiliary heat exchanger during the defrost cycle, so that the hot gaseous refrigerant directed through the first coil means of the auxiliary heat exchanger warms the second coil means of the auxiliary heat exchanger so the refrigerant directed into the second coil means is more efficiently evaporated.

These and other objects are also achieved by providing an apparatus for use with a heat pump or the like including a refrigerant flow circuit connecting a refrigerant compressor, a reversing valve, an outdoor heat exchanger, an expansion means and an indoor heat exchanger, the heat pump including a heating cycle where refrigerant is directed from the compressor to the indoor heat exchanger to the expansion means to the outdoor heat exchanger and back to the compressor, and a cooling cycle where refrigerant is directed from the compressor to the outdoor heat exchanger to the expansion means to the indoor heat exchanger and back to the compressor. The apparatus comprising an auxiliary heat exchanger, the auxiliary heat exchanger including a first coil means with an input and output side, the first coil means including means for operative connection to the refrigerant circuit for receipt of hot gaseous refrigerant from the compressor therethrough. The auxiliary heat exchanger including a second coil means with an input and output side, the second coil means including means for operative connection with a bypass refrigerant conduit means. The apparatus further including a bypass conduit means for bypassing the indoor heat exchanger, the bypass conduit means adapted for operative connection between the refrigerant circuit and the means for operative connection with a bypass refrigerant conduit means. The apparatus also including valve means operative to direct the refrigerant to the indoor heat exchanger during the heating cycle, and operative to direct the refrigerant to the bypass conduit means and through the auxiliary heat exchanger during the defrost cycle.

These and other objects are also achieved by providing the auxiliary heat exchanger and valve means of the present invention to any refrigeration system where frosting may occur including such a system not used as a heat pump.

Other objects, features and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification including reference to the accompanying figures in which.

Figure 1:
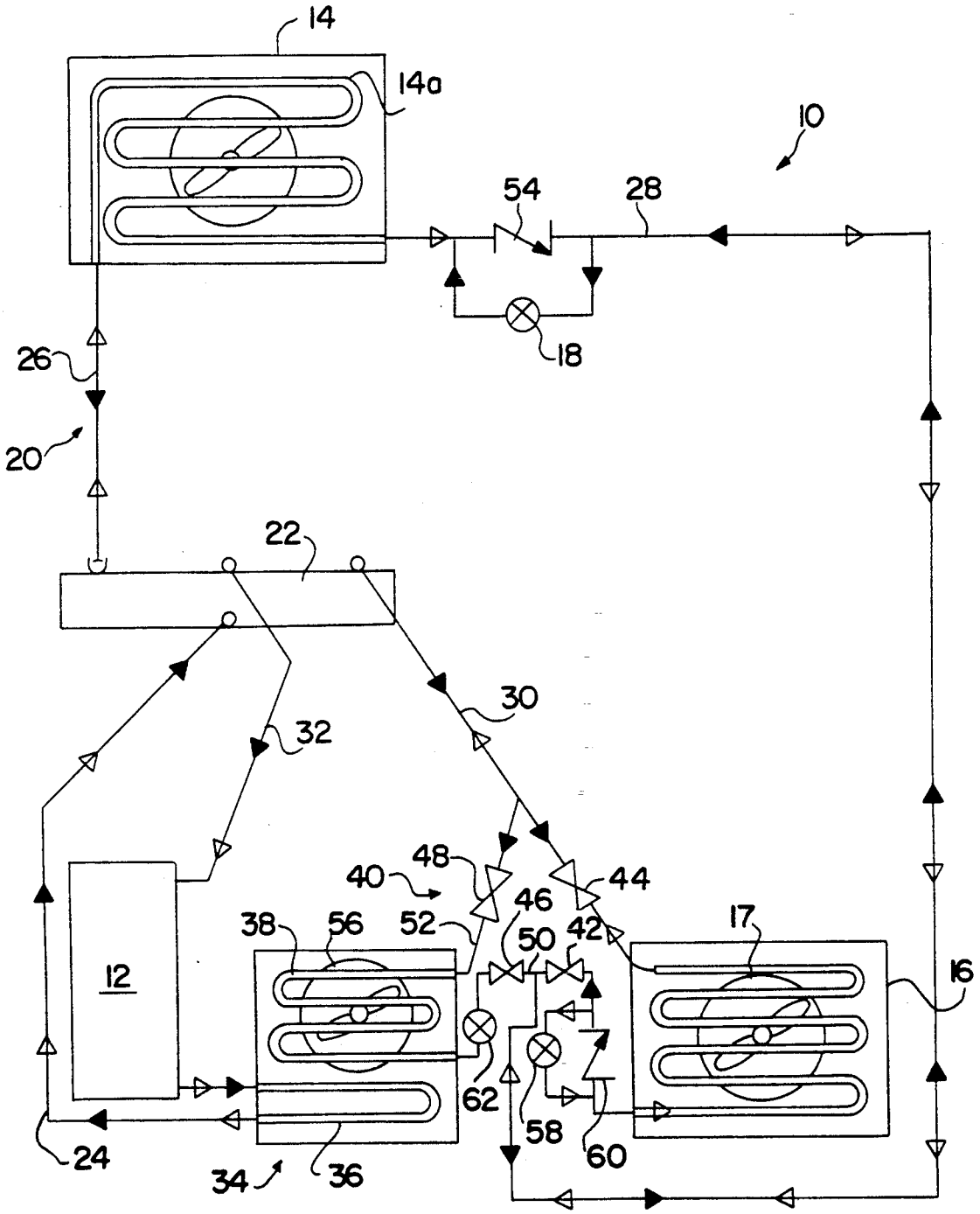
FIG. 1 is a schematic representation of a refrigeration system according to the present invention and illustrating the heating and cooling modes.

Repeat use of reference characters in the present specification and drawings is intended to represent same or analogous features or elements of the invention.

DETAILED DESCRIPTION OF PREFERRED EMBODIMENTS

It is to be understood by those of ordinary skill in the art that the present discussion is a description of exemplary embodiments only, and is not intended as limiting the broader aspects of the present invention, which broader aspects are embodied in the exemplary constructions.

Referring to FIG. 1, a refrigeration circuit 10 is shown generally and specifically for use as a heat pump or the like. The heat pump includes a refrigerant compressor 12, an outdoor or first heat exchanger 14, expansion means 18 and 58, and an indoor or second heat exchanger 16, all connected by a primary refrigerant flow circuit 20. The outdoor heat exchanger 14 and indoor heat exchanger 16 include air handler means such as blowers 15 and 17, respectively. Indoor and outdoor heat exchangers 16 and 14 can be of any conventional design as one of ordinary skill in the art would readily realize.

The primary refrigerant flow circuit 20 includes a reversing valve 22 for controlling the direction of flow of the refrigerant in the flow circuit 20 and conduit means fluidly connecting the elements of the refrigeration circuit. Reversing valve 22 can be operated to connect the discharge side of compressor 12 either to the indoor heat exchanger or the outdoor heat exchanger and simultaneously to connect the suction side of the compressor to the other heat exchanger. The primary refrigerant flow circuit also includes check valves 54 and 60 for directing the refrigerant either through or around expansion means 18 and 58 as commonly used in refrigeration circuits depending on the cycle in operation.

Expansion means 18 is preferably an expansion valve and expansion means 58 and 62 are preferably capillary tubes as are known in the art. However, for purposes of this invention, expansion valves and capillary tubes are interchangeable, and either can be used at either location.

The primary refrigerant flow circuit 20 includes a first portion 24 fluidly connecting the compressor 12 to the reversing valve 22, a second portion 26 fluidly connecting the reversing valve to the outdoor or first heat exchanger 14, a third portion 28 fluidly connecting the outdoor heat exchanger 14 to the indoor or second heat exchanger 16, a fourth portion 30 fluidly connecting the indoor heat exchanger 16 to the reversing valve 22, and a fifth portion 32 fluidly connecting the reversing valve 22 to the suction side of compressor 12.

Figure 2:
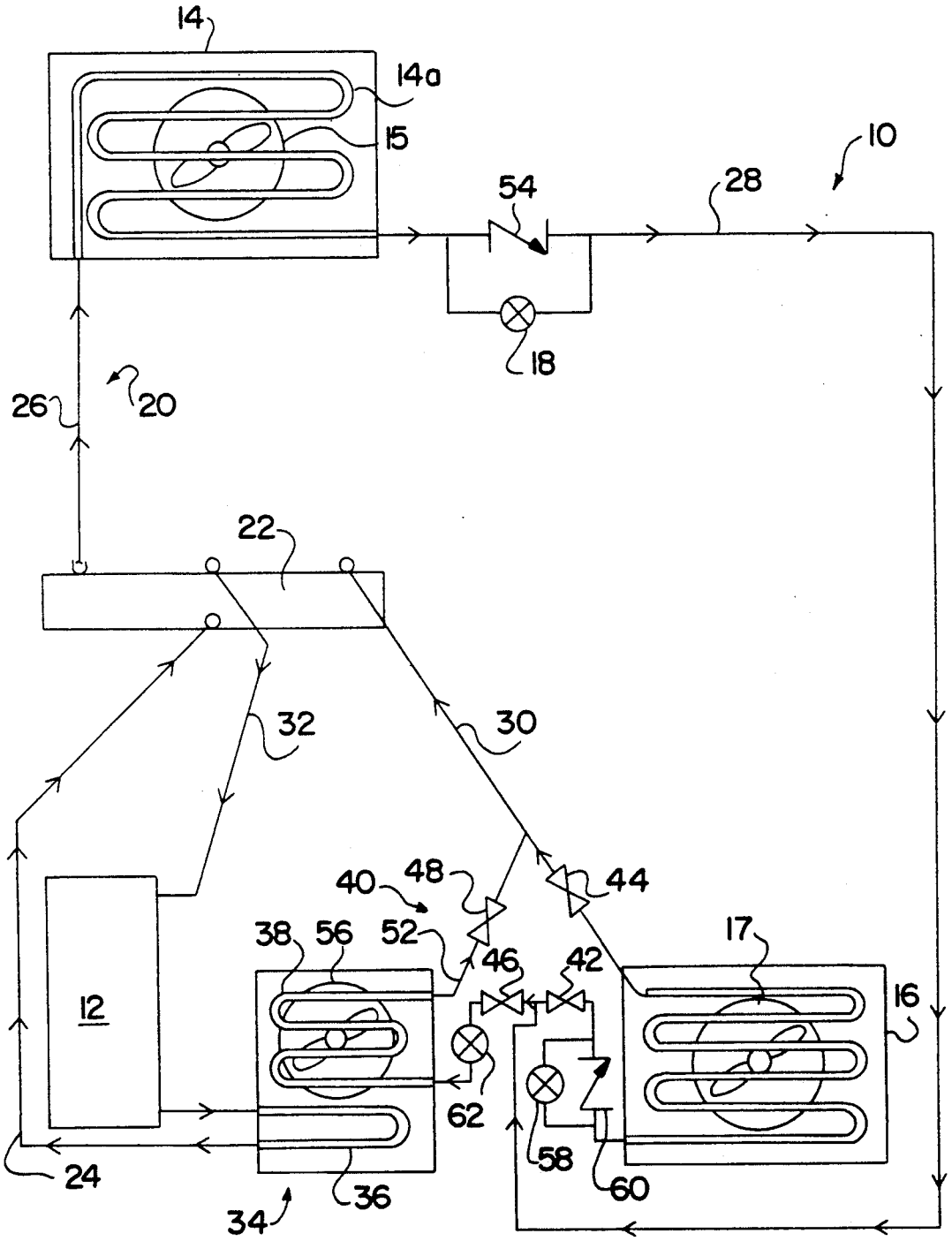
FIG. 2 is a schematic representation of a refrigeration system according to the present invention and illustrating the defrost mode.

The heat pump as illustrated in FIGS. 1 and 2 also includes an auxiliary heat exchanger 34. The auxiliary heat exchanger 34 includes a first coil means 36 and a second coil means 38. The first coil means 36 is operatively connected to the compressor 12 such that hot gaseous refrigerant flows from the output side of the compressor 12, through the first coil means and to the reversing valve 22. As embodied herein, the first coil means 36 is a single loop of refrigerant conduit 37, but could be any desired number of loops. The auxiliary heat exchanger 34 also includes air handler means such as a blower as illustrated at 56.

Heat pump 10 also includes a bypass refrigerant circuit comprising bypass refrigerant conduit means generally illustrated at 40. The bypass conduit means 40 is operative to bypass the indoor heat exchanger 16 during a defrost cycle. The bypass conduit means 40 connects the primary refrigerant flow circuit 20 to the second coil means 38 of the auxiliary heat exchanger 34 so that the second coil means 38 functions as an evaporator in the defrost cycle. The bypass refrigerant conduit means 40 includes a first portion 50 connecting the primary conduit means 20 to the input side of the second coil means 38. The first portion 50 operatively connects with the primary conduit means between the expansion means 18 and the indoor heat exchanger 16 so as to be capable of transferring refrigerant while bypassing the indoor heat exchanger 16. The bypass conduit means includes a second portion 52 connecting the output side of the second coil means 38 of auxiliary heat exchanger 34 to the primary conduit means between the indoor heat exchanger 16 and the reversing valve 22.

The heat pump also includes valve means operative to direct the refrigerant to the indoor heat exchanger 16 during the heating cycle and to direct the refrigerant through the bypass conduit means 40 and into the second coil means 38 of the auxiliary heat exchanger 34 during the defrost cycle. The hot gaseous refrigerant directed through the first coil means 36 of the auxiliary heat exchanger 34 warms the second coil means 38 of the auxiliary heat exchanger 34 so that the refrigerant directed into the second coil means is more efficiently evaporated.

As embodied herein, the valve means includes a first valve 42 located in the primary refrigerant flow circuit between the expansion means 18 and the indoor heat exchanger 16, a second valve 44 located in the primary refrigerant flow circuit between the indoor heat exchanger 16 and the reversible valve 22, a third valve 46 located in the first portion 50 of the bypass conduit means 40 and a fourth valve 48 located in the second portion 52 of bypass conduit means 40 between the auxiliary heat exchanger 34 and the primary refrigerant flow circuit 20.

Valves 42, 44 and 46 are preferably positive non-restrictive solenoid valves that allow completely non-restricted flow when open and completely stop flow when closed. An example of such a valve would be a ball-type valve. Valve 48 is preferably a solenoid valve that provides positive restriction in only one direction, allowing refrigerant to escape from second coil 38 at all times, but not allowing flow from the primary conduit portion 30 into portion 52 at any time. Therefore, during the defrost cycle, refrigerant flows freely out of second coil means 38 and through valve 48. When the defrost cycle is terminated and the heat cycle resumed, valve 48 will prevent refrigerant from entering line 52 and coil means 38 from line 30, while allowing refrigerant remaining in coil means 38 to escape through valve 48 into line 30. Valve 48 could also be a check valve.

While it is preferred for valves 42, 44 and 46 to be positive non-restrictive valves, it is also possible to use valves that are positive in one direction and have a bleed tube or other means that allows for some flow in the opposite direction even when the valve is closed. If such valves are used at 42 and 44, they should be somewhat oversized with respect to the conduit. This is preferred because in the direction that these valves are positive, i.e., the direction that they completely stop flow, the flow is normal when the valve is open. However, free flow is inhibited when the valve is open and refrigerant flows in the opposite direction because the bypass or bleed tube causes some restriction in the orifice. Therefore, if the valve is oversized, the flow even in the restricted direction will be at least equal to that of the conduit, and flow of the refrigerant will not be restricted in either the heat or cool mode.

Furthermore, since it is desirable to prevent flow of refrigerant out of the coil 38 in the direction of line 50 after the defrost cycle, if a valve that is positive restricting in one direction only is used at 46, an additional valve adjacent 46 should be used facing the opposite direction so that flow out of the auxiliary heat exchanger in the direction of line 50 will be completely stopped, i.e., without bleed-through as discussed above, and the refrigerant will exit into line 52.

The heat pump as illustrated in FIGS. 1 and 2 is capable of operation in a heating cycle, a cooling cycle and a defrost cycle as will be explained in more detail below. Operation of the heat cycle is illustrated in shaded arrows in FIG. 1. Hot gaseous refrigerant exits compressor 12 and flows through first coil means 36 of the auxiliary heat exchanger 34. The refrigerant then flows into the reversing valve 22 and is directed to the indoor heat exchanger 16. In this cycle, valves 44 and 42 are open and valves 48 and 46 are closed. The refrigerant is directed from the exit of indoor heat exchanger 16 through check valve 60, through open valve 42, through expansion means 18 and into outdoor heat exchanger 14. The refrigerant is then directed back to the reversing valve 22 and to the input or suction side of compressor 12.

In the cooling cycle, as illustrated in unshaded arrows in FIG. 1, refrigerant is directed from compressor 12 through first coil means 36 of the auxiliary heat exchanger 34 and into the reversing valve 22. Refrigerant is then directed to the outdoor heat exchanger 14, through check valve 54, through expansion means 58, and into indoor heat exchanger 16. In the cooling cycle, valves 46 and 48 are closed and valves 42 and 44 are open. Refrigerant is then directed from the indoor heat exchanger 16 to the reversing valve 22 and to the input or suction side of the compressor. In the heating and cooling cycle, blowers 15 and 17 are utilized to maintain air flow over the coils.

In the defrost cycle, as illustrated in FIG. 2 with open arrows, refrigerant is directed from the output side of compressor 12 through the first coil means 36 of the auxiliary heat exchanger 34. From the output of the first coil means 36, refrigerant is directed into the reversing valve 22 and into the outdoor heat exchanger 14 to defrost its coils, 14*a*. Refrigerant is then directed through check valve 54. In the defrost cycle, valves 42 and 44 are closed and valves 46 and 48 are open. Refrigerant bypasses the indoor heat exchanger 16 and is directed through valve 46, through expansion means 62 and to the input side of the second coil means 38 of the auxiliary heat exchanger 34. Refrigerant is then directed from the output side of the second coil means 38, through valve 48 and to reversing valve 22 and to the input side of the compressor. In the defrost cycle, blower 17 does not operate and, therefore, does not blow cold air into the enclosed area to be heated. In the heat and cool cycles, blower 56 does not operate.

The heat pump includes a control system to control the operation of the unit in the heat, cool and defrost modes. Such a system is conventional and known to one of ordinary skill in the art and can include, for example, electrical relays. Valves 42, 44, 46 and 48 and auxiliary heat exchanger 34 are connected into the normal heat pump control system so as to operate in the manner described herein. That is, they could be connected into the heat, cool, and defrost relays so as to function as described herein in the various cycles.

Therefore, in all cycles, hot gaseous refrigerant is directed through the first coil means 36 in the auxiliary heat exchanger 34 and serves to warm or preheat the second coil means 38. In the defrost mode, the hot refrigerant is directed to the outdoor heat exchanger 14 to defrost its coils 14*a* and then bypasses the indoor heat exchanger. The auxiliary heat exchanger 34 serves as an evaporator to evaporate the refrigerant to be directed back through the reversing valve 22 and to the compressor.

The preheating of the second coil means by the first coil means in the auxiliary heat exchanger prevents migration of the refrigerant in the auxiliary heat exchanger 34 in the defrost cycle, that is, enables more efficient and complete evaporation of the refrigerant in the second coil means. In addition, after the defrost cycle, this warming of coil means 38 by first coil 36 serves to chase the refrigerant out of second coil means 38 and back into the primary circuit.

It is preferred that the auxiliary heat exchanger be insulated and include input and output air openings which include shutters that remain closed except during the defrost cycle. It is also preferred that the auxiliary heat exchanger be installed in a manner protected from the outside air such as in the crawl area of the structure to be heated or cooled. Alternatively, if well insulated ducting is provided, the auxiliary heat exchanger could be located outside and ducted to receive its air from a protected area such as the crawl space. Auxiliary heat exchanger fan 56 only operates during the defrost cycle. This provides more efficient warming of coils 38 by coil 36 and more efficient operation of the heat pump in general.

It should be understood that the auxiliary heat exchanger can be located in the refrigeration system at any location that would produce the above-mentioned advantages. In addition, various expansion or check valves could be incorporated into the refrigeration system, as would be apparent to one of ordinary skill in the art. Further, the auxiliary heat exchanger could be preheated by means other than lower coil 36, such as alternate heat lamps or the like. In addition, in extremely cold weather, if the auxiliary heat exchanger is not located within an enclosed area such as under a house, it may be necessary or desirable to augment the warming provided by the first coil 36 with heat lamps or the like.

These and other modifications and variations to the present invention may be practiced by those of ordinary skill in the art, without departing from the spirit and scope of the present invention, which is more particularly set forth in the appended claims. It should be understood that the principles of the present invention are applicable to refrigeration systems in general, and use of the terminology heat pump is merely meant to represent a particular operation of a refrigeration system. Furthermore, those of ordinary skill in the art will appreciate that the foregoing description is by way of example only, and is not intended to be limitative of the invention so further described in such appended claims.

What is claimed is:

1. A heat pump or the like with a heating, cooling and defrost cycle, said heat pump including a refrigerant compressor with a suction side and an output side, an outdoor heat exchanger, and an indoor heat exchanger, all connected by a primary refrigerant flow circuit including a reversing valve for controlling the direction of flow of the refrigerant in the flow circuit, said heat pump including:

an auxiliary heat exchanger, said auxiliary heat exchanger including a first coil means and a second coil means, said auxiliary heat exchanger operatively connected to said primary refrigerant flow circuit such that hot gaseous refrigerant from the compressor flows through said first coil means;

bypass refrigerant conduit means for bypassing the indoor heat exchanger during the defrost cycle, said bypass conduit means connecting said primary refrigerant flow circuit to said second coil means of said auxiliary heat exchanger so that said second coil means operates as an evaporator in the defrost cycle; and valve means operative to direct the refrigerant to the indoor heat exchanger during the heating cycle, said valve means further operative to prevent flow into the indoor heat exchanger and direct the refrigerant through the bypass conduit means and into the second coil means of the auxiliary heat exchanger during the defrost cycle whereby the hot gaseous refrigerant directed through the first coil means of the auxiliary heat exchanger warms the second coil means of the auxiliary heat exchanger so that the refrigerant directed into the second coil means is more efficiently evaporated by the auxiliary heat exchanger.

2. A heat pump as in claim 1, wherein said first coil means is a single loop of conduit and said second coil means is a plurality of loops of conduit.

3. A heat pump as in claim 1, wherein said first coil means is connected to the primary refrigerant flow circuit between the compressor output side and the reversing valve.

4. A heat pump or the like with a heating, cooling and defrost cycle, said heat pump including a refrigerant compressor with a suction side and an output side, an outdoor heat exchanger, and an indoor heat exchanger, all connected by a primary refrigerant flow circuit including a reversing valve for controlling the direction of flow of the refrigerant in the flow circuit, said heat pump including:

an auxiliary heat exchanger, said auxiliary heat exchanger including a first coil means a second coil means, said auxiliary heat exchanger operatively connected to said primary refrigerant flow circuit such that hot gaseous refrigerant from the compressor flows through said first coil means;

bypass refrigerant conduit means for bypassing the indoor heat exchanger during the defrost cycle, said bypass conduit means connecting said primary refrigerant flow circuit to said second coil means of said auxiliary heat exchanger so that said second coil means operates as an evaporator in the defrost cycle;

valve means operative to direct the refrigerant to the indoor heat exchanger during the heating cycle, said valve means further operative to direct the refrigerant through the bypass conduit means and into the second coil means of the auxiliary heat exchanger during the defrost cycle whereby the hot gaseous refrigerant directed through the first coil means of the auxiliary heat exchanger warms the second coil means of the auxiliary heat exchanger so that the refrigerant directed into the second coil means is more efficiently evaporated by the auxiliary heat exchanger, wherein said auxiliary heat exchanger is insulated and includes input and output air openings which include shutters adapted to open and close the input and output air openings.

5. A heat pump or the like with a heating cycle, cooling cycle and defrost cycle, said heat pump including a refrigerant compressor with a suction side and an output side, an outdoor heat exchanger, an indoor heat exchanger, expansion means and a refrigerant flow circuit including a reversing valve for controlling the direction of flow of the refrigerant in the flow circuit, said heat pump further including:

an auxiliary heat exchanger, said auxiliary heat exchanger including a first coil means with an input and output side, and a second coil means with an input and output side;

said refrigerant flow circuit including primary refrigerant conduit means connecting in series an output side of the refrigerant compressor to an input side of the first coil means in the auxiliary heat exchanger, an output side of the first coil means to the reversing valve, the reversing valve to the outdoor heat exchanger, the outdoor heat exchanger to the expansion means, the expansion means to the indoor heat exchanger, the indoor heat exchanger to the reversing valve, and the reversing valve to the suction side of the refrigerant compressor; and bypass refrigerant conduit means for bypassing the indoor heat exchanger during the defrost cycle, said bypass conduit means including a first portion connecting said primary conduit means to said input side of said second coil means of said auxiliary heat exchanger, and said bypass conduit means including a second portion connecting the output side of said auxiliary heat exchanger to the primary conduit means, said first and second portions being connected to the primary conduit means so as to allow refrigerant to bypass the indoor heat exchanger in the defrost cycle; and valve means operative to prevent flow into the bypass conduit means from the primary conduit means during the heating and cooling cycle and thereby allow refrigerant to pass through the indoor heat exchanger, said valve means further operative to allow flow into the bypass conduit means from the primary conduit means and prevent flow from the primary conduit means from entering the indoor heat exchanger during the defrost cycle;

so that during the defrost cycle, hot gaseous refrigerant is directed to the outdoor heat exchanger and refrigerant exiting the outdoor heat exchanger bypasses the indoor heat exchanger and is directed into the second coil means of the auxiliary heat exchanger to be evaporated and further so that hot refrigerant discharged from the output of the compressor into the first coil means of the auxiliary heat exchanger warms the auxiliary heat exchanger second coil means so that the refrigerant entering the second coil means of the auxiliary heat exchanger during the defrost cycle will be more efficiently evaporated.

6. A heat pump as in claim 5, wherein said valve means includes a first valve located in the primary conduit means between the outdoor heat exchanger and the indoor heat exchanger, a second valve located in the primary conduit means between the indoor heat exchanger and the reversing valve, a third valve located in the first portion of said bypass conduit means, and a forth valve located in the second portion of bypass conduit means between the auxiliary heat exchanger and the primary conduit means.

7. A heat pump as in claim 6, wherein said first portion of the bypass conduit means connects the primary conduit means between the outdoor heat exchanger and the first valve.

8. A heat pump as in claim 6, wherein said second portion of the bypass conduit means connects the primary conduit means between the second valve and the reversing valve.

9. A heat pump as in claim 5, wherein said first coil means is a single loop of conduit and said second coil means is a plurality of loops of conduit.

10. A heat pump as in claim 5, wherein said auxiliary heat exchanger is insulated and includes input and output air openings which include shutters adapted to open and close the input and output air openings.

11. A heat pump as in claim 6, wherein at least one of said first, second and third valves are positive non-restricting valves that allow unrestricted flow in both directions when open and completely prevent flow when closed.

12. A heat pump as in claim 6, wherein all of said first, second and third valves are positive non-restricting valves that a low unrestricted flow in both directions when open and completely prevent flow when closed.

13. A heat pump as in claim 6, wherein said fourth valve positively prevents flow into the auxiliary heat exchanger when closed, but constantly allows refrigerant to escape the auxiliary heat exchanger into the primary conduit means.

14. An apparatus for use with a heat pump or the like including a refrigerant flow circuit connecting a refrigerant compressor, a reversing valve, an outdoor heat exchanger, an expansion means and an indoor heat exchanger, said heat pump including a heating cycle where refrigerant is directed from the compressor to the indoor heat exchanger to the expansion means of the outdoor heat exchanger and back to the compressor, and a cooling cycle where refrigerant is directed from the compressor to the outdoor heat exchanger to the expansion means to the indoor heat exchanger and back to the compressor, said apparatus comprising:

an auxiliary heat exchanger, said auxiliary heat exchanger including a first coil means with an input and output side, said first coil means including means for operative connection to the refrigerant circuit for receipt of hot gaseous refrigerant from the compressor therethrough;

said auxiliary heat exchanger including a second coil means with an input and output side, said second coil means including means for operative connection with a bypass refrigerant conduit means; and bypass conduit means for bypassing the indoor heat exchanger, said bypass conduit means adapted for operative connection between the refrigerant circuit and the means for operative connection with a bypass refrigerant conduit means; and valve means operative to direct the refrigerant to the indoor heat exchanger during the heating and cooling cycle, and operative to bypass the indoor heat exchanger to prevent flow into the indoor heat exchanger and direct the refrigerant to the bypass conduit means and through the auxiliary heat exchanger during the defrost cycle.

15. An apparatus as in claim 14, wherein said bypass conduit means operatively connects to the refrigerant circuit between the outdoor heat exchanger and the indoor heat exchanger at one location, and between the indoor heat exchanger and the reversing valve at another location, said auxiliary heat exchanger being operatively connected to the bypass conduit means therebetween.

16. An apparatus as in claim 14, wherein said first coil means is a single loop of conduit and said second coil means is a plurality of loops of conduit.

17. An apparatus for use with a heat pump or the like including a refrigerant flow circuit connecting a refrigerant compressor, a reversing valve, an outdoor heat exchanger, an expansion means and an indoor heat exchanger, said heat pump including a heating cycle where refrigerant is directed from the compressor to the indoor heat exchanger to the expansion means to the outdoor heat exchanger and back to the compressor, and a cooling cycle where refrigerant is directed from the compressor to the outdoor heat exchanger to the expansion means to the indoor heat exchanger and back to the compressor, said apparatus comprising:

an auxiliary heat exchanger, said auxiliary heat exchanger including a first coil means with an input and output side, said first coil means including means for operative connection to the refrigerant circuit for receipt of hot gaseous refrigerant from the compressor therethrough;

said auxiliary heat exchanger including a second coil means with an input and output side, said second coil means including means for operative connection with a bypass refrigerant conduit means; and bypass conduit means for bypassing the indoor heat exchanger, said bypass conduit means adapted for operative connection between the refrigerant circuit and the means for operative connection with a bypass refrigerant conduit means; and valve means operative to direct the refrigerant to the indoor heat exchanger during the heating and cooling cycle, and operative to bypass the indoor heat exchanger and direct the refrigerant to the bypass conduit means and through the auxiliary heat exchanger during the defrost cycle, wherein said auxiliary heat exchanger is insulated and includes input and output air openings which include shutters adapted to open and close the input and output air openings.

18. A refrigeration system with a heating, cooling and defrost cycle, said refrigeration system including a refrigerant compressor, a first heat exchanger, a second heat exchanger, and expansion means all connected by a primary refrigerant flow circuit including a reversing valve for controlling the direction of flow of the refrigerant in the flow circuit, said refrigeration system including:

an auxiliary heat exchanger, said auxiliary heat exchanger including a first coil means and a second coil means, said auxiliary heat exchanger operatively connected to said primary refrigerant flow circuit such that hot gaseous refrigerant from the compressor flows through said first coil means;

bypass refrigerant conduit means for bypassing the second heat exchanger during the defrost cycle, said bypass conduit means connecting said primary refrigerant flow circuit to said second coil means of said auxiliary heat exchanger so that said second coil means operates as an evaporator in the defrost cycle; and valve means operative to direct the refrigerant to the second heat exchanger during the heating cycle, said valve means further operative to prevent refrigerant flow into the second heat exchanger and direct the refrigerant through the bypass conduit means and into the second coil means of the auxiliary heat exchanger during the defrost cycle whereby the hot gaseous refrigerant directed through the first coil means of the auxiliary heat exchanger warms the second coil means of the auxiliary heat exchanger so that the refrigerant directed into the second coil means is more efficiently evaporated by the auxiliary heat exchanger.

19. A refrigeration system as in claim 18, wherein said first coil means is a single loop of conduit and said second coil means is a plurality of loops of conduit.

20. A refrigeration system as in claim 18, wherein said first coil means is connected to the primary refrigerant flow circuit between the compressor output and the reversing valve.

21. A refrigeration system with a heating, cooling and defrost cycle, said refrigeration system including a refrigerant compressor, a first heat exchanger, a second heat exchanger, and expansion means all connected by a primary refrigerant flow circuit including a reversing valve for controlling the direction of flow of the refrigerant in the flow circuit, said refrigeration system including:

an auxiliary heat exchanger, said auxiliary heat exchanger including a first coil means and a second coil means, said auxiliary heat exchanger operatively connected to said primary refrigerant flow circuit such that hot gaseous refrigerant from the compressor flows through said first coil means;

bypass refrigerant conduit means for bypassing the second heat exchanger during the defrost cycle, said bypass conduit means connecting said primary refrigerant flow circuit to said second coil means of said auxiliary heat exchanger so that said second coil means operates as an evaporator in the defrost cycle; and valve means operative to direct the refrigerant to the second heat exchanger during the heating cycle, said valve means further operative to direct the refrigerant through the bypass conduit means and into the second coil means of the auxiliary heat exchanger during the defrost cycle whereby the hot gaseous refrigerant directed through the first coil means of the auxiliary heat exchanger warms the second coil means of the auxiliary heat exchanger so that the refrigerant directed into the second coil means is more efficiently evaporated by the auxiliary heat exchanger, wherein said auxiliary heat exchanger is insulated and includes input and output air openings which include shutters adapted to open and close the input and output air openings.

22. A heat pump or the like with a heating cycle, cooling cycle and defrost cycle, said heat pump including a refrigerant compressor with a suction side and an output side, an outdoor heat exchanger, an indoor heat exchanger, expansion means and a refrigerant flow circuit including a reversing valve for controlling the direction of flow of the refrigerant in the flow circuit, said heat pump further including:

an auxiliary heat exchanger, said auxiliary heat exchanger including a first coil means with an input and output side, and a second coil means with an input and output side;

said refrigerant flow circuit including primary refrigerant conduit means connecting in series an output side of the refrigerant compressor to an input side of the first coil means in the auxiliary heat exchanger, an output side of the first coil means to the reversing valve, the reversing valve to the outdoor heat exchanger, the outdoor heat exchanger to the expansion means, the expansion means to the indoor heat exchanger, the indoor heat exchanger to the reversing valve, and the reversing valve to the suction side of the refrigerant compressor; and bypass refrigerant conduit means for bypassing the indoor heat exchanger during the defrost cycle, said bypass conduit means including a first portion connecting said primary conduit means to said input side of said second coil means of said auxiliary heat exchanger, and said bypass conduit means including a second portion connecting the output side of said auxiliary heat exchanger to the primary conduit means, said first and second portions being connected to the primary conduit means so as to allow refrigerant to bypass the indoor heat exchanger in the defrost cycle; and valve means operative to prevent flow into the bypass conduit means from the primary conduit means during the heating and cooling cycle and thereby allow refrigerant to pass through the indoor heat exchanger, said valve means further operative to allow flow into the bypass conduit means from the primary conduit means and prevent flow from the primary conduit means from entering the indoor heat exchanger during the defrost cycle, said valve means including a valve located in the primary conduit means between the outdoor heat exchanger and the indoor heat exchanger, and a valve located in the second portion of bypass conduit means between the auxiliary heat exchanger and the primary conduit means;

so that during the defrost cycle, hot gaseous refrigerant is directed to the outdoor heat exchanger and refrigerant exiting the outdoor heat exchanger bypasses the indoor heat exchanger and is directed into the second coil means of the auxiliary heat exchanger to be evaporated and further so that hot refrigerant discharged from the output of the compressor into the first coil means of the auxiliary heat exchanger warms the auxiliary heat exchanger second coil means so that the refrigerant entering the second coil means of the auxiliary heat exchanger during the defrost cycle will be more efficiently evaporated.

* * * * *